United States Patent [19]

Bilen

[11] Patent Number: 4,469,041

[45] Date of Patent: Sep. 4, 1984

[54] RUDDER STEERING APPARATUS FOR SHIPS

[75] Inventor: Branislav J. Bilen, Belgrad, Yugoslavia

[73] Assignee: Institut Tehnickih Nauka Srpsfe Akademije Nauka I Umetnosti, Belgrad, Yugoslavia

[21] Appl. No.: 358,660

[22] Filed: Mar. 16, 1982

[51] Int. Cl.[3] ..... B63H 25/06

[52] U.S. Cl. ..... 114/144 R; 114/162

[58] Field of Search ..... 114/150, 162, 163, 171, 114/172, 144 R; 244/75 R, 87, 89; 74/470, 599

[56] References Cited

U.S. PATENT DOCUMENTS 3,611,827 10/1971 Botlum ..... 74/471 R
3,905,241 9/1975 Downing et al. ..... 244/75 R X
4,201,146 5/1980 Branislav ..... 114/163

FOREIGN PATENT DOCUMENTS 2490585 3/1982 France ..... 114/163

*Primary Examiner*—Sherman D. Basinger
*Attorney, Agent, or Firm*—Laubscher, Philpitt & Laubscher

[57] ABSTRACT

An improved rudder steering apparatus for ships is disclosed including a rudder-jam-responsive device for automatically disconnecting the tiller from the rudder shaft upon the occurrence of jamming or wedging of the rudder. A pair of cam track levers pivotally connected with a plate mounted on the rudder shaft are normally biased by an hydraulic piston-cylinder motor into engagement with a follower that is connected with the tiller. The motor is automatically operable by an overload-responsive device (such as a pressure-relief safety valve or an accumulator tank) to disconnect the levers from the follower device when the rudder is in a wedged or jammed condition.

8 Claims, 3 Drawing Figures

RUDDER STEERING APPARATUS FOR SHIPS

BRIEF DESCRIPTION OF THE PRIOR ART

In the inventor's prior U.S. Pat. No. 4,201,146 issued May 6, 1980, an apparatus is disclosed for temporarily disconnecting from the steering mechanism of a ship one of a plurality of rudders that is in a jammed, stuck or wedged condition. In this prior system the overload on the rudder shaft and corresponding disturbances can be eliminated, whereby the normal operation of the other rudders in the system is assured.

The known device consists of a center rudder shaft connected with the rudder drive means which, at its ends, has the wheels of a cam follower arrangement, which wheels engage the flat parts and are positioned on the pistons of oil cylinders supplied with pressure fluid via a safety valve, while the middle portion of the guide contains no arcuate recess. The center shaft is connected with a sliding ring having a boss that sets the rudder shaft in motion. Under normal operating conditions, when the stress on the rudders is normal, the center shaft wheels have a certain movement on the flat portion of the guide member and the nominal movement is normally transmitted to the boss and the rudder axle. If the stress exceeds the anticipated values, the center shaft moves so far that its wheels will press on the guide member which transmits the pressure to the pistons of the oil cylinders and displaces the oil. Because of that, the guide member sinks, the follower wheels slide into the arc-shaped recess and interrupt the system. The moment the cause of the wedging has been eliminated, the pressure on the pistons of the oil cylinders disappears, the pressure rises in the cylinders, and causes the guide member to be placed in its normal position, while the center pole is brought into operating positions and the control function is continued.

The prior art device, however, contains certain drawbacks such as incomplete reliability, delay in reconnection and the like. The purpose of this invention is the elimination of all of the defects noted and to provide completely reliable operation.

SUMMARY OF THE INVENTION

Accordingly, it is the primary object of the present invention to provide improved rudder steering apparatus for ships, including releasable means normally connecting the tillar with the rudder shaft, and rudder-jam-responsive means automatically operable upon the occurrence of rudder jamming for disconnecting the tiller from the rudder shaft.

According to a more specific object of the invention, the means normally connecting the tiller with the rudder shaft upon which it is concentrically and rotatably mounted, includes a boss concentrically and non-rotatably mounted on the rudder shaft, and means releasably connecting the tiller with the boss, including a plate secured in concentric relation to the boss, a pair of spaced levers pivotally connected at one end with the plate on opposite sides of the rudder shaft, said levers being provided with opposed cam tracks on their adjacent surfaces, a cam follower connected with the tiller between the cam track in the levers, and releasable means normally biasing the levers together into engagement with the cam follower means, whereby angular displacement of the tiller normally produces corresponding angular displacement of the rudder shaft. Overload-responsive means are provided for automatically separating the levers from the cam follower means when the associated rudder is in a wedged or jammed condition. Preferably the lever biasing means includes a piston-cylinder motor connected between the free ends of the levers, and conduit means for supplying pressure fluid to the motor to normally maintain the piston in a collapsed condition relative to the motor cylinder. Load responsive means—such as a pressure-relief safety valve for an accumulator tank—are operable upon overload to vent the motor to sump and thereby release the piston for movement to the extended condition relative to its cylinder, whereby the levers are automatically separated from the cam follower to disengage the tiller from the rudder shaft.

BRIEF DESCRIPTION OF THE DRAWING

Other objects and advantages of the invention will become apparent from a study of the following specification when viewed on the light of the accompanying drawing, in which.

DETAILED DESCRIPTION

Figure 1:
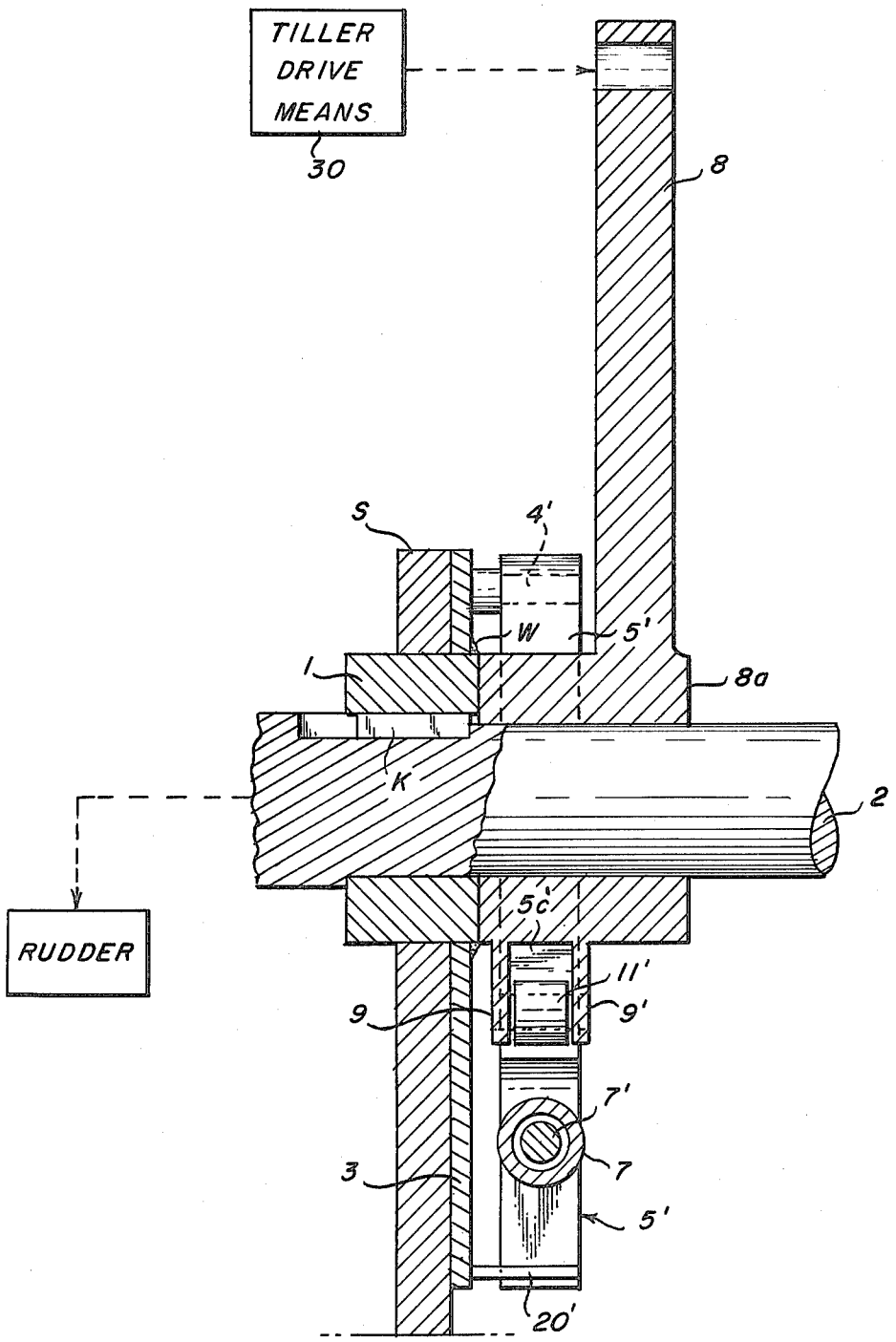
FIG. 1 is a sectional view of the improved rudder steering apparatus of the present invention taken along line 1—1 of FIG. 2.
Figure 2:
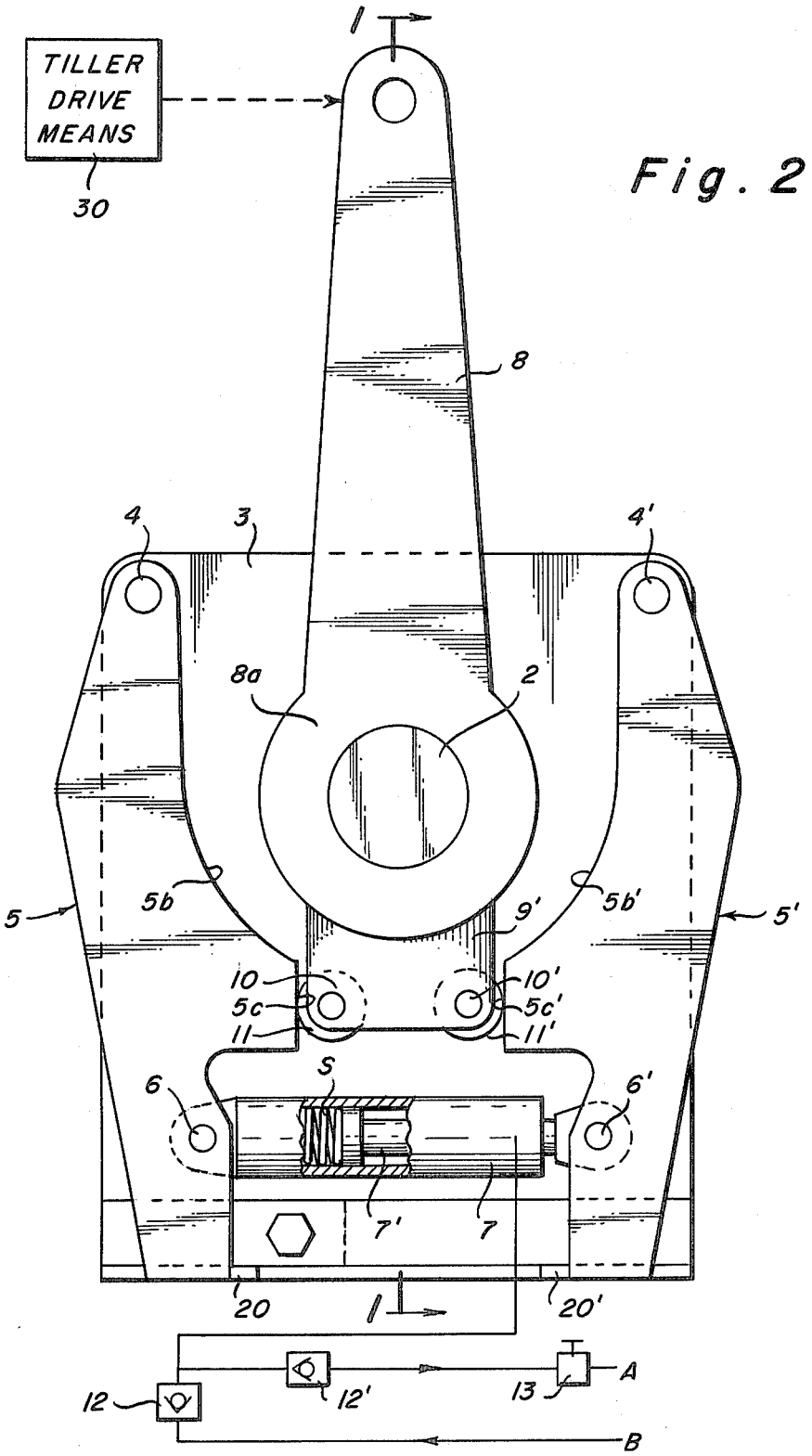
FIG. 2 is a top plan view of the rudder steering apparatus of the present invention when in the normal operating condition.

Referring now more particularly to FIGS. 1 and 2, rudder steering control apparatus of the present invention includes a cylindrical boss 1 that is journalled in fixed support S and is non-rotatably keyed to the rudder shaft 2 by means of key K. Welded to the boss 1, by weld seam W is a rigid metal plate 3 having rigidly secured thereto a pair of pivot shafts 4, 4' to which are pivotally connected at one end a pair of cam levers 5, 5', respectively, which cam levers are provided with opposed concave cam track portions **5*b*, 5*b*', and opposed straight cam track portions 5*c*, 5*c*'**, respectively.

Connected at opposite ends between the lower ends of the cam levers 5, 5' by means of pivot shafts 6, 6', respectively, is a shock-absorbing piston-cylinder motor 7 including an outer cylindrical housing, and an inner piston rod 7'. Stops 20, 20' are connected with the plate 3 for limiting the extent to which the cam levers pivot toward each other.

The tiller member 8, which is angularly displaced by the tiller drive means 30, includes an integral tubular hub portion **8*a* journalled on rudder shaft 2, and a pair of parallel spaced projecting plate portions 9, 9' having mounted therebetween a pair of parallel shafts 10, 10' upon which are rotatably mounted a pair of cam follower rollers 11, 11', respectively. As shown in FIG. 2, the rollers 11, 11' normally engage opposed flat cam portions 5*c*, 5*c*' on the levers 5, 5', respectively. The piston-cylinder motor 7 comprises a shock absorbing device to the right end of the working chamber of which pressure fluid is supplied from oil pump B via first check valve 12. The aforementioned working end of the piston-cylinder motor 7 is connected also with sump A via a second check valve 12' and a pressure-relief safety valve 13**.

OPERATION

Figure 3:
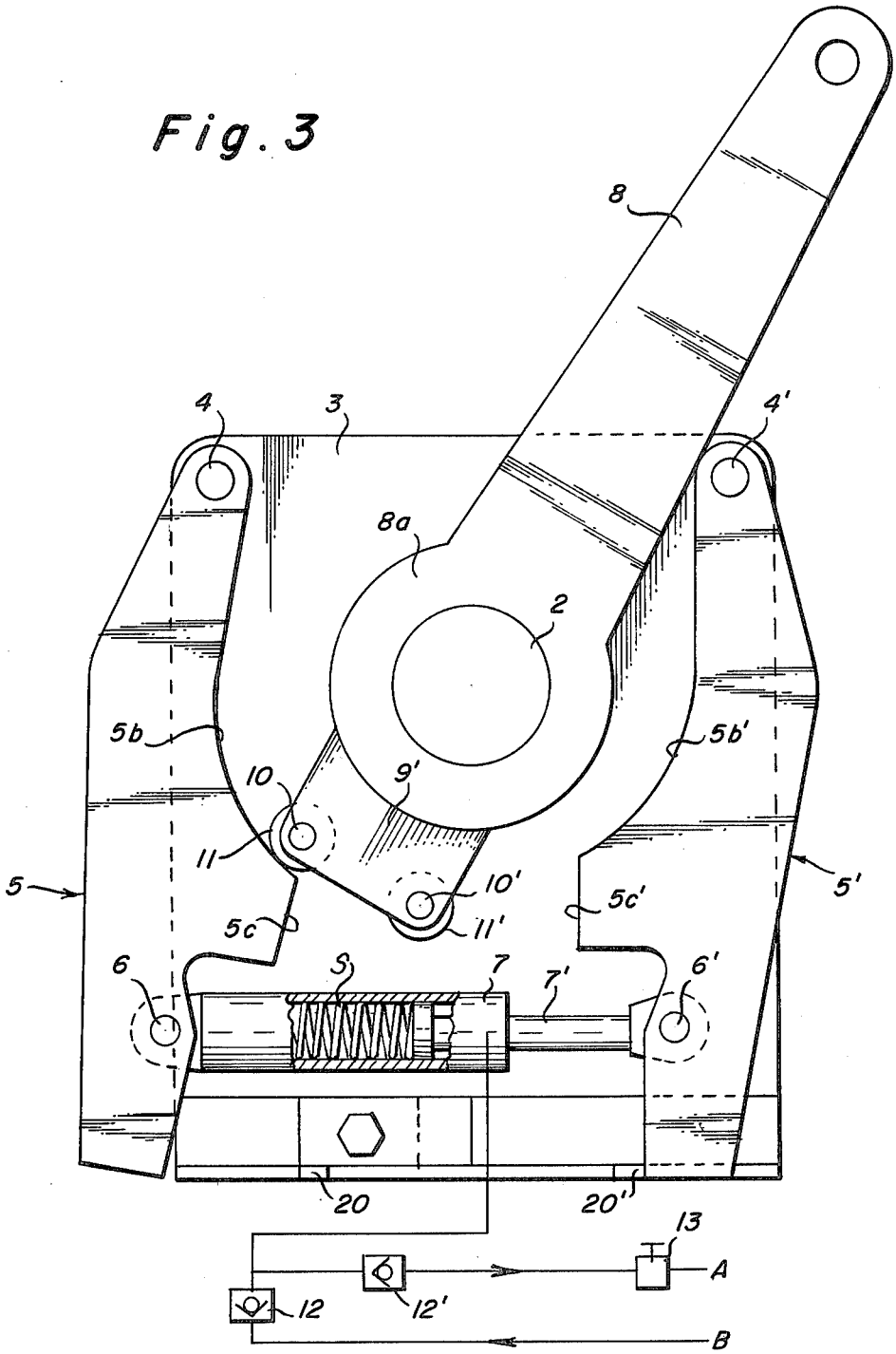
FIG. 3 is a top plan view corresponding to FIG. 2 when the apparatus is in the rudder-jam-responsive released condition.

In normal steering operation, angular motion imparted to tiller 8 by the tiller drive means 30 is normally transmitted to the flat portions 5c, 5c' of cam levers 5, 5' via the tiller hub portion 8a, extensions 9 and cam follower rollers 11, 11'. Relief valve 13 is in a closed or throttling position, whereupon pressure fluid is supplied to the right hand end of motor 7 to bias piston 7' inwardly toward its illustrated retracted position, thereby causing cam tracks 5c, 5c' to engage the follower rollers 11, 11', respectively. Consequently, the angular movement of tiller 8 is transmitted to rudder shaft 2 via pivot shafts 4, 4', plate 3, boss 1 and key K. During this normal operation, the safety valve 13 is in the closed or throttled condition, and pressure fluid from pump B is supplied to motor 7 via check valve 12, thereby maintaining piston 7' in the withdrawn position relative to its cylinder, as shown in FIG. 3.

Assume now that the rudder associated with the rudder shaft 2 is in a jammed or wedged condition, thereby causing the tiller drive means to be overloaded. The helmsman, who does not realize that the rudder has become wedged, causes movement of the rudder engine in an attempt to angularly displace the tiller 8 and the rollers 11, 11' in the clockwise direction. Owing to the resistance on the rudder shaft 2 caused by the wedged rudder, rotational movement of the assembly including boss 1, plate 3, and levers 5, 5' is resisted, thereby causing the fluid pressure in the hydraulic system to increase beyond the setting of the safety relief valve 13. The pressure fluid is then vented from piston-cylinder motor 7 to sump via check valve 12' and relief valve 13, whereupon piston 7' is released and lever 5 is displaced by roller 11 in the clockwise direction toward the position shown in FIG. 3. Thus, room is made for the left follower wheel 11 to slide (in this operating example of the device) onto the slide track 5b of lever 5, at this time, the mechanical system is separated, that is to say, the mechanical connection between the rudder drive means and the rudder shaft is interrupted. In this way, the wedged rudder is disconnected from the system and, due to its disconnection, it facilitates the unhindered motion of the other rudders. The movement of the wedged rudder in the opposite direction takes place in a similar manner. The left wheel 11 goes down from the slide track 5b of lever 5. As it goes down from the slide track 5b, follower wheel 11 creates a free space for closing the shock-absorbing cylinder 7 which is again constantly under the pressure of the oil supplied from the pump, whereby the device is once again connected in the initial position of FIG. 2. If the cause of the wedging is not eliminated, then, during movement, the right wheel 11' will perform the same process as the left wheel 11. This will be repeated until the cause of the wedging has been eliminated. After the cause has been eliminated, the device will be connected again by itself and will make it possible for this rudder to move and to perform its function, together with the other rudders of the system.

The oil used for movement can be taken from the general oil tank of the vessel or it can be returned to it or there is a possibility of each of these systems described to have its oil tank.

As an alternative, an oil accumulator may be substituted for the safety relief valve 13. Furthermore, if desired, the motor 7 may include a spring S biasing the piston 7' toward its extended condition shown in FIG. 3.

What is claimed is:

1. Apparatus for releasably connecting an angularly displaceable tiller to a rudder shaft upon which it is concentrically mounted, comprising, (a) a rudder shaft (2);

(b) a tiller (8) including a main portion having at one end a hollow cylindrical portion (8a) mounted concentrically upon said rudder shaft;

(c) a tubular boss (1) concentrically mounted on, and non-rotatably connected with, said rudder shaft adjacent said tiller cylindrical portion; and (d) means releasably connecting said tiller with said boss, including (1) a plate (3) containing an opening receiving one end of said boss, said plate being secured to said boss;

(2) a pair of generally parallel spaced levers (5, 5') arranged on opposite sides of said tiller cylindrical portion, respectively, each of said levers being pivotally connected at a first end with said plate on one side of said tiller cylindrical portion, respectively, said levers extending at their other ends beyond said tiller cylindrical portion, the adjacent surfaces of said lever other ends being provided with opposed parallel flat first cam track surfaces (5c, 5c'), the adjacent surfaces of said levers intermediate said first cam track surfaces and said lever first ends being provided on their adjacent surfaces with opposed concave second cam track surfaces (5b, 5b');

(3) cam follower means (11, 11') connected with said tiller cylindrical portion on the opposite side of, and diametrically arranged relative to, the main portion of said tiller for cooperation with said first cam track surfaces;

(4) releasable means (7) normally biasing said levers together to effect engagement between said cam follower means and said first cam track surfaces; and (5) jam-responsive means operable in response to a jammed condition of said rudder shaft for releasing said lever biasing means, whereby under normal operating conditions, angular displacement of said tiller is transmitted to said rudder shaft via said cam follower means, said levers, said plate and said boss, and upon the occurrence of rudder jamming the biasing means is released to disconnect said tiller from said rudder shaft.

2. Apparatus as defined in claim 1, wherein said cam follower means comprises a pair of rollers (11, 11') arranged for cooperation with the cam track surfaces on said levers, respectively.

3. Apparatus as defined in claim 2, wherein said lever biasing means comprises a piston-cylinder motor (7) connected between the free ends of said levers.

4. Apparatus as defined in claim 3, and further including means (B) for normally supplying pressure fluid to said motor to maintain the piston (7) of said motor in a retracted position relative to the cylinder of the motor.

5. Apparatus as defined in claim 4, wherein said jam-responsive means includes means for venting the pressure fluid from said motor upon the occurrence of jamming said rudder shaft.

6. Apparatus as defined in claim 5, wherein said jam-responsive means comprises a pressure-relief safety valve (13).

7. Apparatus as defined in claim 5, wherein said jam-responsive means includes a fluid accumulator.

8. Apparatus as defined in claim 1, and further including stop means (20, 20') connected with said plate for limiting the extend of pivotal movement of said levers toward each other.

* * * * *